United States Patent [19]

Rivero

[11] Patent Number: 4,871,171

[45] Date of Patent: Oct. 3, 1989

[54] GAME DEVICE INCLUDING MEANS SIMULATING RELEASE OF A BALL

[75] Inventor: Francisco B. Rivero, Madrid, Spain

[73] Assignee: Recreativus Franco, S.A., Madrid, Spain

[21] Appl. No.: 174,122

[22] Filed: Mar. 28, 1988

[30] Foreign Application Priority Data

Mar. 30, 1987 [ES] Spain ..... 87/01027
Mar. 30, 1987 [ES] Spain ..... 87/01030

[51] Int. Cl.[4] ..... A63F 5/00
[52] U.S. Cl. ..... 273/138 A; 273/144 R
[58] Field of Search ..... 273/144 R, 144 A, 144 B, 273/138 A

[56] References Cited

U.S. PATENT DOCUMENTS 2,187,046 1/1940 McLean ..... 273/144 A
2,203,886 6/1940 Zamora ..... 273/144 A
3,140,875 7/1964 Abbott et al. ..... 273/144 B

FOREIGN PATENT DOCUMENTS 821171 8/1937 France ..... 273/144 A
2485936 1/1982 France ..... 273/144 A

*Primary Examiner*—Anton O. Oechsle

[57] ABSTRACT

An auxiliary game for incorporation in a slot machine of the type in which winning combinations of a series of different combinations of symbols are controlled electronically to appear in a group of windows causing a prize to be delivered to an operator. The auxilliary game includes a cage carrying numbered lottery balls arranged to rotate and to release a ball into a transparent tube. A simulation of the ball number is arranged by electronic control to show in a window thereby to indicate a consolation prize. Ball release is controlled by a ball escapement mounted at a ball outlet of the cage and operable to release only a single ball from the cage into the tube at one time and to return the ball to the cage during progressive rotation of the cage.

7 Claims, 3 Drawing Sheets

GAME DEVICE INCLUDING MEANS SIMULATING RELEASE OF A BALL

The invention consists of a device designed to be attached to a slot machine, with or without a starter lever, and which makes it more attractive, rewarding constancy, and maintaining the player's interest during and at the finish of normal games.

Obviously, the interest of the game lies in the primary combination which, after respective moves, appears in three aligned windows. It may or may not make up a prize-winning combination, which in turn may or may not cause the prize to fall into the respective coin compartment. There is a supplementary option of certain forward moves which allow a figure or upper solitary central window to be combined and transferred to any of the aligned windows until the prize is reached, all of which is done by personally pressing certain buttons, which increases the feeling of being able to modify chance by more or less successful action, already claimed in Spanish Utility Model No. 270,565 by the same applicant.

Specifically, the Spanish Utility Model No. 270,565 discloses a device comprising, basically, a front panel in which a provisional number of openings have been made in the form of a row of windows, these being of the same size and parallel alignment, in which the various figures or symbols that make up the combinations appear in succession and come to a standstill, these figures or symbols being projected, in a known manner, by means of an appropriate set of projectors.

Positioned above the parallel line of windows there is another solitary window with the same shape and size as the others, and during the course of each combination a symbol or figure appears in this opening which can be the same or different to those shown in the combination.

The figure or symbol, which has come to a standstill in the solitary window can be substituted for any of those forming part of the combination obtained and can therefore transferred to this combination to form part of a new one, this operation being carried out manually by the player.

In order to achieve this, there is a button or control knob belows each lower opening or window. These buttons or control knobs can light up in succession and, while illuminated, pressing them causes the image projected in the appropriate window to change to that of the image of in the upper window and in this way the latter image is incorporated into the main combination.

This change of image operation can be carried out as many times as allowed for by the value accumulated during previous games, this value being on show in a further window.

In playing the game, if a specific combination is obtained by means of normal methods which do not correspond to any prize, in order to win a prize it is of interest to cause one of the figures forming part of the combination which has come to a standstill in the row of windows to be substituted by the figure appearing in the separate window.

In order to do this, it is necessary to wait until a knob corresponding to a particular window where the change is desired, lights up, and at that moment press this knob to produce the substitution whereby the image reflected in the upper window is transferred to the particular window.

It is possible to effect this operation successively, in the same way and as many times as allowed for by the number of turns indicated in the further window, and the change can be made to any of the windows forming part of the combination.

However, taking into account the speed with which all these steps occur, the player may lose interest, or his attention may be distracted to the point that he gets bored and stops playing, thus foregoing the probability of winning or hitting a grand prize; for this reason, a complementary game has been contrived, linked in a way to the basic or general game of the machine, thus rewarding constancy and adding more interest to the game, getting the player more involved.

The invention achieves this effect by building a complementary game of chance into the machine. It consists of a rotating device which simulates the random extracting of a numbered ball from a drum or spherical cage, described below.

There are certain games in which the attraction lies in using simulating contrivances to complement a merely electronic effect, and which allow real movements to be made. Repeating these movements fulfills a visual objective, but does not really perform any function in the game. Strict conditioning factors must, nonetheless, be complied with since the complementary game is just as important as the game itself.

In the case of using such a well-known game as the "lottery", removing the ball will have to be performed in the most realistic manner possible. This is the idea behind the device of this invention, which we are going to describe with reference to the attached drawings, showing a preferred embodiment thereof, given by way of example and not of a limiting nature.

Figure 1:
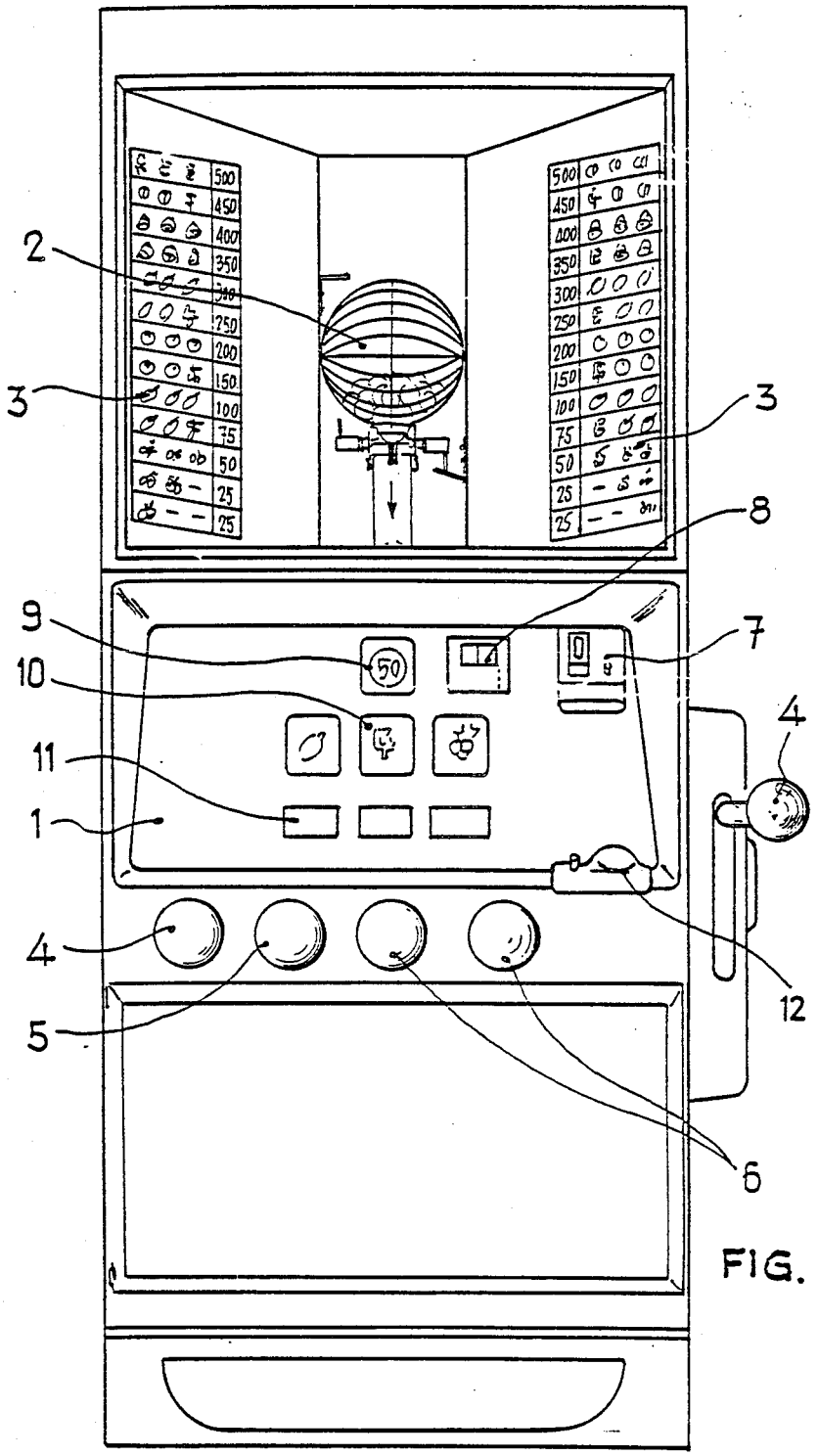
FIG. 1 shows a front view of a slot machine incorporating the fundamental principles of the invention.

In FIG. 1, which shows a front view of a slot machine to which a complementary game has been added, with the simulated removal of numbered balls from a rotating drum as in a lottery, the game front can be seen in -1- with both the starter lever and button indicated as -4-, in view of the fact that either can be used to start the game once a coin has been inserted in the slot -12-. Coins of higher value can be placed in slot -7- and the difference will remain in the machine as a creditor or be returned on pressing button -5-.

When the machine starts to operate, a series of figures appears in equal aligned windows -10-. The combination has to form a winning set, programmed in the panels -3- of the top front. It is possible to make a series of transfers from the solitary window -9- to any of the windows -10- by simply pressing the button -11- corresponding to the window to be modified -10-, forcing a winning combination. In the event of being unsuccessful, despite all these facilities, including the credits shown in the split window -8- and pressing the buttons -6-, there would be a last opportunity of winning by continuing to play the complementary game. This is indicated in one of the windows -10-. By pressing the buttons -6-, you can take part in the lottery with the rotating drum -2-, participating with the prize indicated on a ball shown in window -9- which now simulates removing the ball from the rotating drum of the complementary game.

Figure 2:
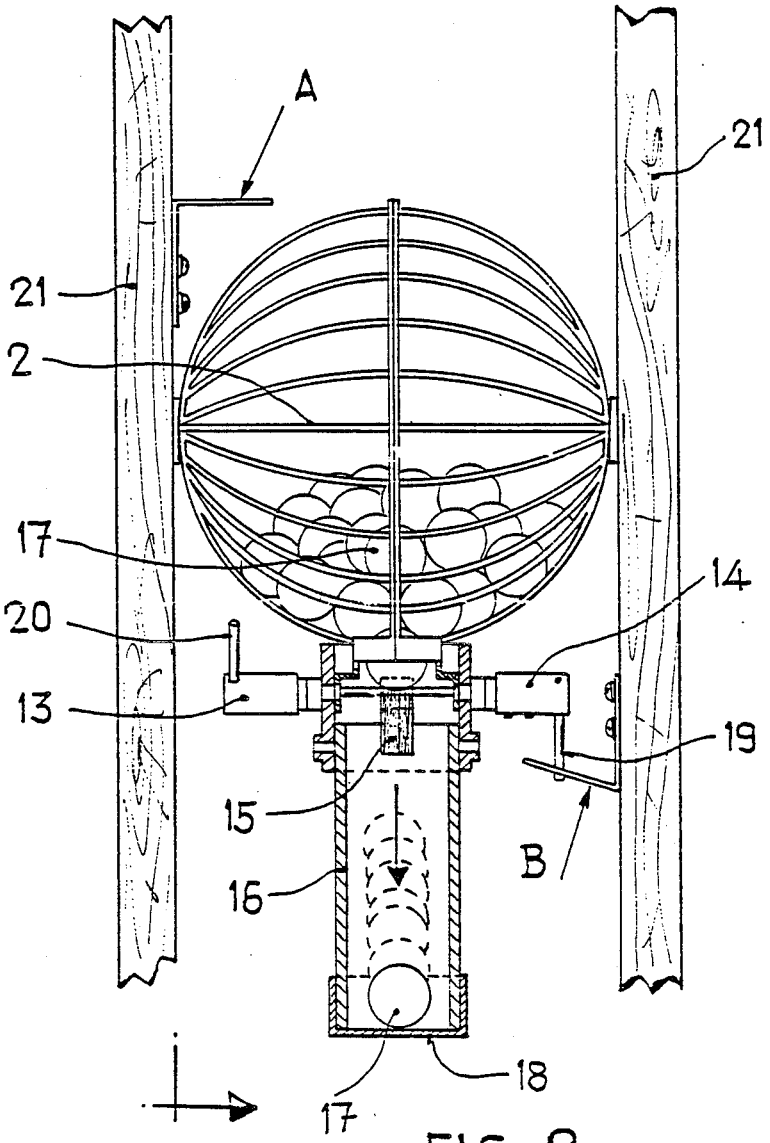
FIG. 2 shows a front view of the device that simulates the extracting of a ball from a drum, secured by two panels of the machine to which it is attached and with a ball removed.

FIG. 2 shows how the cage or spherical drum -2- is diametrically hinged to the panels -21- of a normal slot machine. As it rotates on these panels, moved by a small motor (not shown), there is a slight amount of friction, and the numbered balls -17- turn inside it.

On an equatorial point of this drum -2-, perpendicular to the spin axis, there is an inlet or orifice on which a coupling -16*a*- is fitted and secured, to which a transparent tube -16- is connected, closed at its free end by a lid -18- so that the said tube -16- turns with the drum -2- following its movement. At the inlet coupling -16*a*-, and arranged transversally, there is a flap -15-at right angles with different sized arms -15*a*- and -15*b*-, arm -15*b*- being larger than -15*a*-. The latter covers approximately half the outlet of the balls -17-.

In the panels -21- on which the drum -2- turns, two stops A and B are placed, on both sides. Their height and separation are calculated with respect to the arms -19- and -20- integral with the flap -15- and which protrude from the coupling -16*a*- in diametrically opposed positions and mounted in housings -13- and -14-. The one corresponding to stop A is shorter than that of stop B. There are placed exactly in the perpendicular of the bisector of the square formed by the aforementioned flap -15-.

Figure 3:
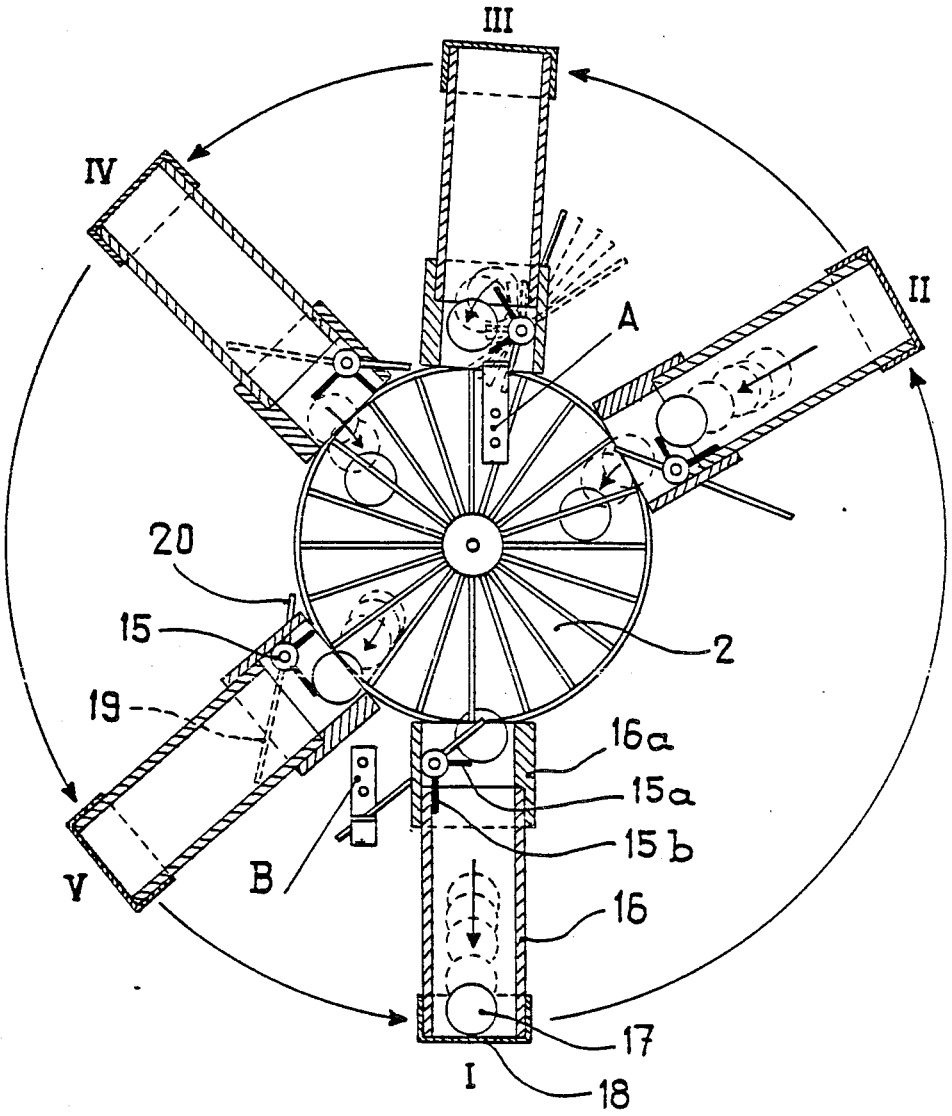
FIG. 3 shows a side view of the device shown in FIG. 2, in five successive turning positions, which complete the five operation stages.

In FIG. 3 positions -I- to -V- can be seen, and the turning direction of the device; as shown in position -I-, we can see how a ball -17- has fallen, stopped by cover -18- of the transparent tube -16-, giving the impression that it have been counted. The flap -15- has the biggest branch -15*b*- down, and the short arm or branch -15*a*- closing the inlet and holding the ball which tries to fall. The drum continues to turn as the arm -19- passes to stop B.

As it continues to turn, in the direction marked by the arrow, and takes position -II-, the ball -17- rests, by its own weight, on the short branch of the flap -15- underneath, whereas the ball which was resting inside falls into the drum, all of which occurs without the flap -15- moving until position -III- is reached in which the arm -19- of the flap meets the upper stop A. making the square turn 90°, putting in the ball which was resting and which, as seen in position -IV-, will fall by its own weight inside the drum -2-, leaving the long arm closing the outlet, in order to house a ball in position -V-, so that in position -I- it falls into the coupling -16-, because as rod -19- passes by stop B on the other side the drum stops turning and the square returns to its original position, it not being possible to drag 2 balls, in this turn, due precisely to the different length of the arms or wings of the square which now puts the short arm in the pile of intermixed balls in the drum -2-.

I claim:

1. A complementary game for electronically controlled slot machines of the type which comprise a cabinet having a front panel;

a front window located at a top of the front panel;

a set of small windows extending across the center of the panel below the front window in which capricious symbols are shown, a corresponding set of pushbuttons below said windows, operable respectively to effect voluntary transfer of the symbol appearing in the top window to respective of the windows therebelow to force a winning combination;

at least one further window adjacent the top window showing forward moves allowing other similar attempts;

the complementary game being activatable if a player has not obtained a prize in the basic game and a window and button or suitable projection being arranged to indicate the possibility of playing the complementary game;

the complementary game comprising a drum mounted for rotation in the cabinet;

numbered balls confined in the drum; and, means to release a prize ball from the drum for simulation in the front window thereby to indicate the prize.

2. A complementary game according to claim 1 in which the drum is formed by a spherical cage rotatably mounted on a horizontal axis extending between two uprights in the cabinet of the slot machine;

the game further comprising an outlet orifice for the balls at a location on the equator of the cage perpendicular to the spin axis;

a coupling attached to the outlet;

a ball escapement mounted in the coupling;

a ball receiving tube connected at one end to the coupling and extending away from the cage and closed at the other free end;

the escapement comprising means for permitting release only of the single ball during rotation of the cage.

3. A complementary game according to claim 2 in which the escapement comprises flap means comprising first and second branches of different lengths extending at right angles to each other and pivotally mounted for rotation across the tube to retain or extract only a single ball from the cage on pivotal rotation through 90°.

4. A complementary game according to claim 3 in which the flap means are pivoted at the point of intersection of the branches for pivotal rotation in the same plane as the plane of the cage rotation, the shorter arm having a length extending from the pivot to a location flush with the outlet.

5. A complementary game according to claim 3 in which the flap means is mounted at the intersection of the branches on a axis extending outside opposite sides of the coupling; two arms of different lengths and linear projection extending radially from both sides of the remote ends of each projection, according to the perpendicular of the bisector of the square of the flap to which they belong, upper and lower stops on the cabinet on opposite sides of the cage arranged so that when the cage turns the arm will first touch the upper stop on one side, causing the flap to pivot through 90° and, subsequently, the lower stop on the opposite side, which cancels the pivotal movement and orients the flap at right angles in a position to release a ball and to retain those balls contained inside the cage.

6. A complementary game according to claim 4 in which the cage is mounted on the cabinet at a location above the top window and the ball receiving tube extends towards the top window.

7. A complementary game for electronically controlled slot machines of the type which comprise a cabinet having a front panel;

a front window located at a top of the front panel;

a set of small windows extending across the center of the panel below the front window in which capricious symbols are shown, a corresponding set of pushbuttons below said windows, operable respectively to effect voluntary tranfer of the symbol appearing in the top window to respective of the windows therebelow to force a winning combination;

at least one further window adjacent the top window showing forward moves allowing other similar attempts;

a window and button or suitable projection being arranged to indicate the possibility of playing the complementary game;

the complementary game comprising a spherical cage rotatably mounted in view of a player above the top window on a horizontal axis extending between two uprights in the cabinet of the slot machine;

numbered balls confined in the cage;

an outlet orifice for the balls at a location on the equator of the cage perpendicular to the spin axis;

a coupling attached to the outlet;

a ball escapement mounted in the coupling;

a ball receiving tube connected at one end to the coupling and extending away from the cage toward the top window and being closed at the other free end;

the escapement comprising means for permitting release only of a single ball from the cage during rotation thereof for simulation in the front window to indicate a prize.

* * * * *

UNITED STATES PATENT AND TRADEMARK OFFICE

CERTIFICATE OF CORRECTION

PATENT NO. : 4,871,171

DATED : October 3, 1989

INVENTOR(S) : Francisco Benito Rivero

It is certified that error appears in the above-identified patent and that said Letters Patent is hereby corrected as shown below:

On the title page, in item [73]
The assignee should be indicated as:

Recreativos Franco, S.A.

Signed and Sealed this

Thirtieth Day of June, 1992

*Attest:*

DOUGLAS B. COMER

*Attesting Officer*

*Acting Commissioner of Patents and Trademarks*